US005782404A

United States Patent [19]

Robichaud et al.

[11] Patent Number: 5,782,404

[45] Date of Patent: Jul. 21, 1998

[54] PACKAGE OPENING

[75] Inventors: Arthur W. Robichaud; Dennis W. Bender, both of Worthington, Ohio

[73] Assignee: Combibloc, Inc., Columbus, Ohio

[21] Appl. No.: 775,759

[22] Filed: Dec. 31, 1996

Related U.S. Application Data

[63] Continuation of Ser. No. 45,316, Apr. 7, 1993, abandoned, which is a continuation of Ser. No. 663,712, Mar. 4, 1991, abandoned.

[51] Int. Cl.[6] ..... B65D 77/28

[52] U.S. Cl. ..... 229/103.1; 229/125.15; 229/204; 383/202; 206/217

[58] Field of Search ..... 229/103.1, 125.15, 229/137, 204; 220/705, 709, 710; 206/217; 383/202

[56] References Cited

U.S. PATENT DOCUMENTS

| | | | |
|---|---|---|---|
| 1,243,033 | 10/1917 | Beatty | 229/103.1 X |
| 2,740,575 | 4/1956 | Fontaine | 229/103.1 |
| 3,048,317 | 8/1962 | Cochrane et al. | 229/103.1 |
| 3,226,001 | 12/1965 | Sequeira | 229/103.1 |
| 3,524,566 | 8/1970 | Parks | 229/103.1 |
| 3,792,798 | 2/1974 | Chang | 229/103.1 |
| 4,429,828 | 2/1984 | Färber | 229/103.1 |
| 4,498,585 | 2/1985 | Gordon et al. | 229/103.1 X |
| 4,553,693 | 11/1985 | Terajima et al. | 229/103.1 X |
| 4,591,091 | 5/1986 | Wise | 229/103.1 |
| 4,690,294 | 9/1987 | Jones | 229/103.1 |
| 4,712,737 | 12/1987 | Hecking | 229/103.1 |
| 4,858,766 | 8/1989 | Tsai | 229/245 X |
| 5,052,614 | 10/1991 | Xuan | 229/103.1 |
| 5,201,459 | 4/1993 | Bettle, Jr. et al. | 229/103.1 |

FOREIGN PATENT DOCUMENTS

| | | | |
|---|---|---|---|
| 1045895 | 12/1958 | Germany | 229/103.1 |

*Primary Examiner*—Allan N. Shoap
*Assistant Examiner*—Robin A. Hylton
*Attorney, Agent, or Firm*—Standley & Gilcrest

[57] ABSTRACT

An improved straw hole design for a drink package which allows venting to occur in air gaps around the straw while the straw is inserted in the straw hole. This invention prevents the common problem of squirting or spill-over out of the top of the straw when a drink box is squeezed or otherwise compressed. Several embodiments are disclosed in which a "C" shaped pre-cut, a "U" shaped pre-cut and "V" shaped pre-cut are incorporated into the package for later insertion of the straw.

1 Claim, 2 Drawing Sheets

PACKAGE OPENING

This application is a file wrapper continuation of application Ser. No. 08/045,316 filed Apr. 7, 1993 abandoned which is a continuation of U.S. patent application Ser. No. 07/663,712 filed Mar. 4, 1991, now abandoned.

BACKGROUND AND SUMMARY OF THE INVENTION

The present invention relates generally to straw holes in food and beverage packages. More particularly, the present invention is an improved design for a straw hole that allows air to vent from around a straw to avoid the messy problem of contents squirting out of the straw when the package is compressed by picking it up or slightly squeezing the package.

Drink boxes or "juice boxes", as they are sometimes called, have become very popular in many countries around the world. These drink boxes may come in single serve sizes and up and usually come with a straw in a protective, sterile wrapper attached to the outside of the box. The top of the drink box has a predetermined, premarked location for insertion of one end of the straw for the consumer to drink the contents of the box through the straw. Typically, the premarked location for the straw insertion has been pre-cut in some fashion to assist ease of insertion of the straw, yet not to break the liquid seal of the box prior to insertion of the straw.

A typical drink box of today is aseptic in nature and is well-known to those of ordinary skill in the art. However, the present invention would be useful on non-aseptic packages as well. Aseptic packages are multi-layered structures, usually comprising a paperboard layer with plastic layer(s) such as polyethelyne and in some cases, an oxygen barrier layer such as aluminum foil. In premarking a location on the box top for insertion of a straw, aseptic packages are usually half cut. A half cut may be placed through the paperboard layer, leaving the foil and usually one or more layers of plastic intact to maintain the liquid barrier seal prior to insertion of the straw. In known packages or boxes, once the straw is inserted through the half cut and pierces the liquid seal barrier to enter the contents of the box, the layers of the box tend to form around the straw resulting in an air seal between the perimeter of the straw and the box layers around the straw.

This seal between the straw and the layers of the box surrounding the straw hole causes an unfortunate problem. When the box is handled by the consumer, the contents of the box tend to squirt out of the top of the straw unintentionally when the box is even slightly compressed. Applicants have discovered that one way of avoiding this problem is to allow venting of air trapped at the very top of the box above the contents level through the straw hole outside the perimeter of the straw. To prevent the box material from forming a seal around the straw required a novel half cut straw hole design. The present application discloses three different embodiments of this unique pre-cut, self-venting straw hole.

In one preferred embodiment, a "C" shaped half cut is formed in the package top for a location for insertion of a straw. When the straw is inserted, a "C" shaped flap of material is formed which is diverted into the package by the straw. Due to the nature of the layered material of the package the "C" shaped flap of material will tend to spring back to a closed position which results in the flap exerting a force against the straw. This force pressing the straw against the opposing wall of the hole will slightly grip the straw keeping the straw from loosely moving within the straw hole. The "C" is somewhat larger in diameter than the straw diameter. Once the straw is in place in the hole there will be gaps on either side of the straw to allow air to vent from around the straw through the straw hole when the package is compressed. Another embodiment that functions in substantially the same way is comprised of a "U" shaped half cut straw hole. Yet another embodiment incorporates a substantially "V" shaped straw hole. It will be recognized that various shaped straw hole openings may be incorporated to provide venting space around the straw that would fall within the scope of the present invention.

DESCRIPTION OF PREFERRED EMBODIMENT (S)

Figure 1:
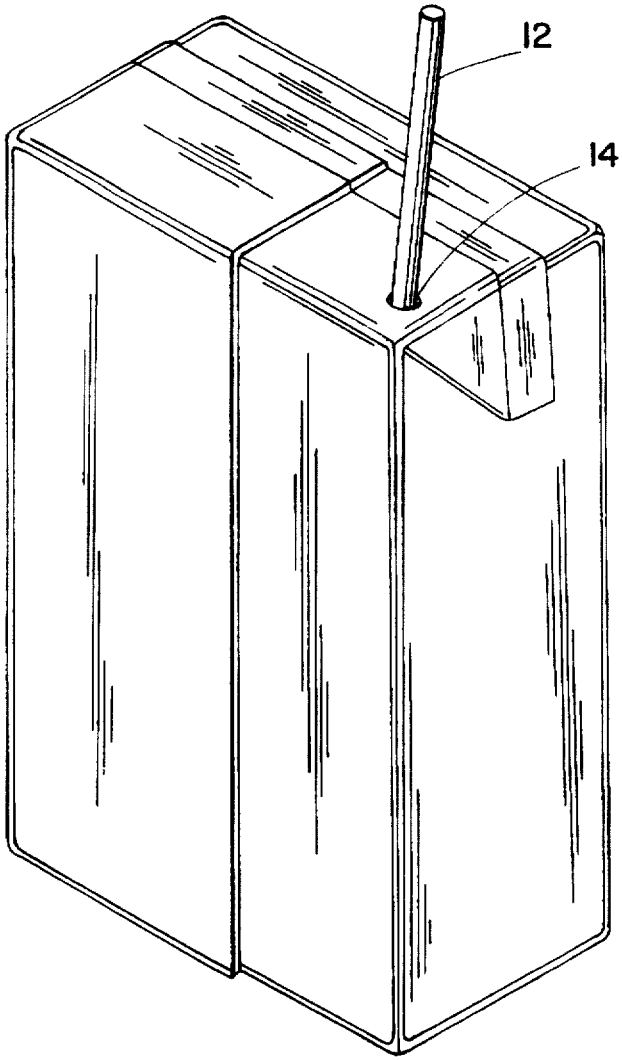
FIG. 1 is a perspective view of a drink box package having a straw in a straw hole which incorporates the present invention.
Figure 4:
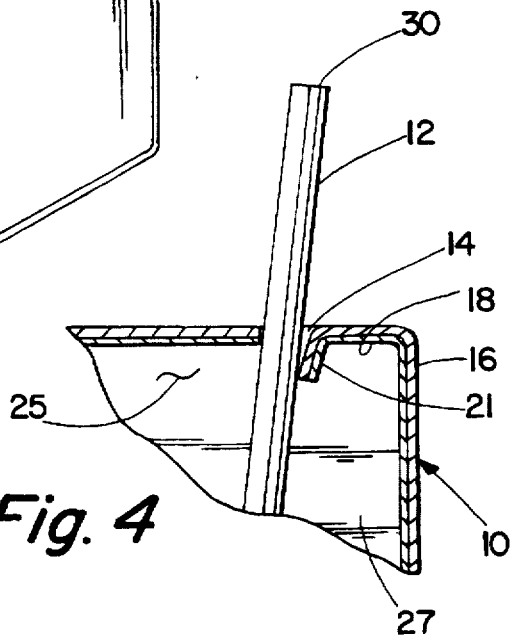
FIG. 4 is a partial sectional view taken along Line 4—4 of FIG. 3.

Referring now to the drawings, and particularly FIG. 1 there is shown a typical drink box package 10 of a type that is widely known and may typically contain a beverage such as juice, soda pop, other flavored drinks, or even liquid foods such as soup. Typically, the package 10 is provided with a straw 12 to be inserted into a straw hole. The straw hole 14 of the present invention may be partially pre-cut into a layer 16 of the package 10 as shown in FIG. 4. Drink boxes are ordinarily manufactured with several layers of material including a paperboard layer and an oxygen barrier layer along with plastic layers. By pre-cutting or "half-cutting" the outer paperboard layer 16 of the package 10 without disturbing the inner product barrier layer(s) 18 the consumer will have a readily recognizable location for insertion of the straw 12 and actual insertion of the straw 12 will be accomplished more easily since the paperboard layer 16 will have already been pre-cut.

Figure 2:
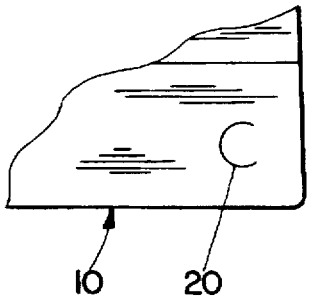
FIG. 2 is a partial plan view of the top of a package having a pre-cut "C" shaped straw hole.
Figure 3:
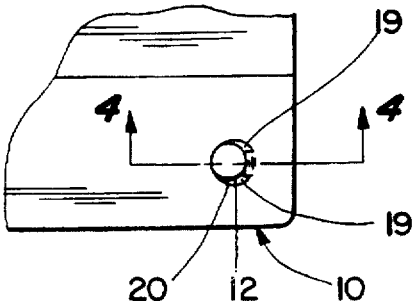
FIG. 3 is a partial plan view of the package of FIG. 2 having a straw inserted in the straw hole.

As shown in FIG. 2, a "C" shaped pre-cut 20 is made in the paperboard layer 16 of the package 10 and is of a size to be somewhat larger in diameter than the diameter of the straw 12. In FIG. 3, the straw 12 is shown inserted in the "C" shaped vent hole 20. Gaps 19 will occur between the package layers and the perimeter of the straw 12. A flap 21 of package 10 layers 16, 18 will protrude down into the package 10 and tend to spring back against the straw 12. This is advantageous because it keeps the straw 12 under control and does not allow it to float around loosely within the hole 14. Air 25 trapped above the contents 27 of the package will be vented through the gaps 19 when the package 10 is even slightly compressed.

Figure 5:
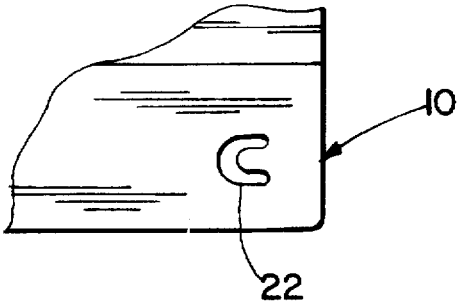
FIG. 5 is a partial plan view of the top of a package having a pre-cut "U" shaped straw hole.
Figure 6:
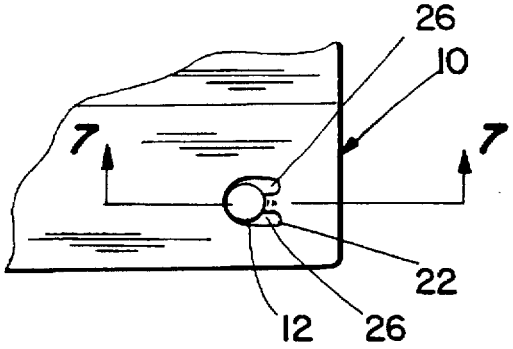
FIG. 6 is a partial plan view of the package of FIG. 5 showing a straw inserted in the straw hole.
Figure 7:
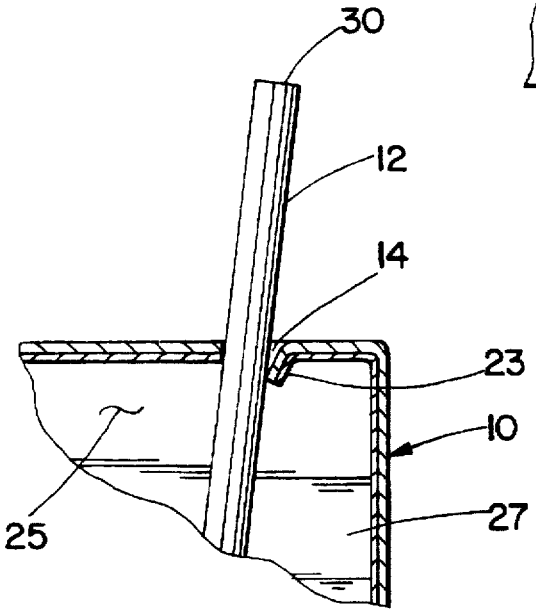
FIG. 7 is a partial sectional view taken along Line 7—7 of FIG. 6.

Referring now to FIG. 5, another embodiment of the present invention is shown, wherein a "U" shaped pre-cut 22 vent hole is incorporated into the package 10. In FIG. 6 the straw 12 is shown inserted in the "U" shaped vent hole 22 and gaps 26 are present around the perimeter of the straw 12. As shown in FIG. 7, the flap 23 of material layers of the package 10 is again diverted into the package 10 and exerts a force against the straw 12 to prevent the straw 12 from loosely floating within the hole 14. In the same manner as described above, the air 25 at the top of the package 10 above the contents 27 will be vented out of the package 10 through the gaps 26 whenever the package 10 is squeezed or otherwise compressed.

Figure 8:
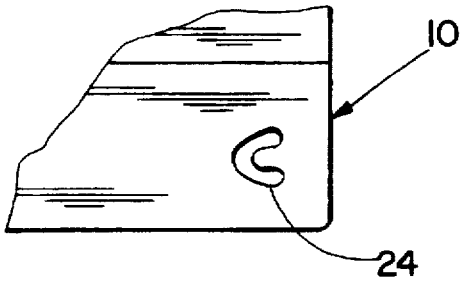
FIG. 8 is a partial plan view of the top of a package having a "V" shaped pre-cut straw hole.
Figure 9:
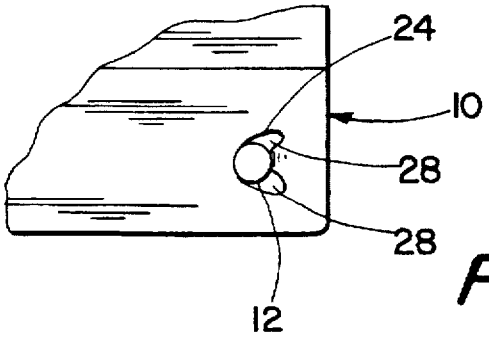
FIG. 9 is a partial plan view of the package of FIG. 8 showing a straw inserted in the straw hole.

As shown in FIGS. 8 and 9, yet another embodiment of the present invention which functions in substantially the same way is a "V" shaped pre-cut 24 vent hole for insertion of a straw 12. Gaps 28 occur around the straw 12 which allow air 25 to vent from the package 10. All of the above described embodiments, and other embodiments that would fall within the scope of the present invention will prevent the squirting or spill-over of contents 27 from out of the top 30 of the straw 12 unintentionally when the straw 12 is not in the mouth of the consumer.

What is claimed is:

1. In a combination of an aseptic drink box package and a straw, said aseptic drink box package having an inner layer forming an entirely enclosed aseptic barrier and an outer layer secured to and encapsulating said inner layer, said package layers consisting of materials which may be squeezed by human hands causing a pressure increase within said package, said package equipped for consumption of the contents thereof through the straw, the improvement comprising:

said outer layer including a predetermined shape partially pre-cut into said outer layer thereby defining a straw insertion location on said package, while leaving said inner layer uncut and thereby maintaining the aseptic nature of said package prior to said straw insertion, said shape having a dimension greater than the diameter of the straw, said shape forming a flap that protrudes into said package when pressure is exerted against said shape and creates a hole in said inner layer corresponding in size to the size of said flap, such that when the straw is inserted into said hole, a sufficient gap is present between a perimeter of said hole in said inner layer and the straw, through which air within said package may vent to prevent unwanted spillage of the contents out the straw.

* * * * *